US008152866B2

(12) United States Patent
Buczynsky

(10) Patent No.: US 8,152,866 B2
(45) Date of Patent: Apr. 10, 2012

(54) SYNTHETIC DIESEL FUEL COMPOSITIONS

(75) Inventor: Andrew E. Buczynsky, Brownstown, MI (US)

(73) Assignee: GM Global Technology Operations LLC

( * ) Notice: Subject to any disclaimer, the term of this patent is extended or adjusted under 35 U.S.C. 154(b) by 408 days.

(21) Appl. No.: 12/465,299

(22) Filed: May 13, 2009

(65) Prior Publication Data

US 2010/0287819 A1 Nov. 18, 2010

(51) Int. Cl.
*C10L 1/00* (2006.01)

(52) U.S. Cl. ..... 44/300; 208/16

(58) Field of Classification Search ..... 44/268, 44/300; 208/16

See application file for complete search history.

(56) References Cited

U.S. PATENT DOCUMENTS 4,645,585 A * 2/1987 White ..... 208/58
2005/0023188 A1* 2/2005 Connor ..... 208/15

OTHER PUBLICATIONS

ASTM International Standard Specification for Diesel Fuel Oils D975 (Rev. Dec. 2008). ASTM D2887 (see p. 5 of spec.) (pp. 2-3); ASTM D93 (see p. 6 of spec.) (pp. 2-3 and Table 1 on p. 4); ASTM D613 (see p. 6 of spec) (pp. 2-3 and Table 1 on p. 4); ASTM D6890 (see p. 7 of spec.) (pp. 2-3); ASTM D4737 (see p. 7 of spec.) (p. 2, Table 1 footnotes on p. 4); ASTM D6371 (see p. 9 of spec.) (p. 2, Table 1 on p. 4, and p. 11); ASTM D2500 (see p. 10 of spec.) (pp. 2-3, Table 1 on p. 4, and p. 11).

National Institute of Science and Technology Chemistry Web Book, Standard Reference Database No. 69, copyright 2008, printed on Oct. 21, 2009, http://webbook.nist.gov/cgi/cbook.cgi?Name=butylcyclohexane&Units=SI.

National Institute of Science and Technology Chemistry Web Book, Standard Reference Database No. 69, copyright 2008, printed on Oct. 21, 2009, http://webbook.nist.gov/cgi/cbook.cgi?Name=decane&Units=SI.

National Institute of Science and Technology Chemistry Web Book, Standard Reference Database No. 69, copyright 2008, printed on Oct. 21, 2009, http://webbook.nist.gov/cgi/cbook.cgi?Name=decylbenzene&Units=SI.

National Institute of Science and Technology Chemistry Web Book, Standard Reference Database No. 69, copyright 2008, printed on Oct. 21, 2009, http://webbook.nist.gov/cgi/cbook.cgi?Name=decylcyclohexane&Units=SI.

National Institute of Science and Technology Chemistry Web Book, Standard Reference Database No. 69, copyright 2008, printed on Oct. 21, 2009, http://webbook.nist.gov/cgi/cbook.cgi?Name=dodecylbenzene&Units=SI dated.

National Institute of Science and Technology Chemistry Web Book, Standard Reference Database No. 69, copyright 2008, printed on Oct. 21, 2009, http://webbook.nist.gov/cgi/cbook.cgi?Name=dodecylcyclohexane&Units=SI.

(Continued)

*Primary Examiner* — Walter D Griffin
*Assistant Examiner* — Taiwo Oladapo
(74) *Attorney, Agent, or Firm* — Harness, Dickey & Pierce, P.L.C.

(57) ABSTRACT

In various aspects, a synthetic diesel fuel composition is provided that comprises at least three $C_{10}$-$C_{18}$ hydrocarbon compounds selected from the group consisting of decane, butylcyclohexane, hexylbenzene, hexylcyclohexane, octylbenzene, octylcyclohexane, decylbenzene, decylcyclohexane, dodecylbenzene, and dodecylcyclohexane. The synthetic diesel fuel composition also comprises at least one aromatic hydrocarbon compound at greater than or equal to about 10 vol. % of the total composition. Such synthetic diesel fuel compositions have a cetane number of greater than 40, a freeze point of less than or equal to about −20° C. (about −4° F.), and a density of greater than or equal to about 0.81 g/ml (about 6.8 lb/gal) and may be synthesized from biomass or other alternative fuel sources.

17 Claims, 2 Drawing Sheets

OTHER PUBLICATIONS

Figure 1:
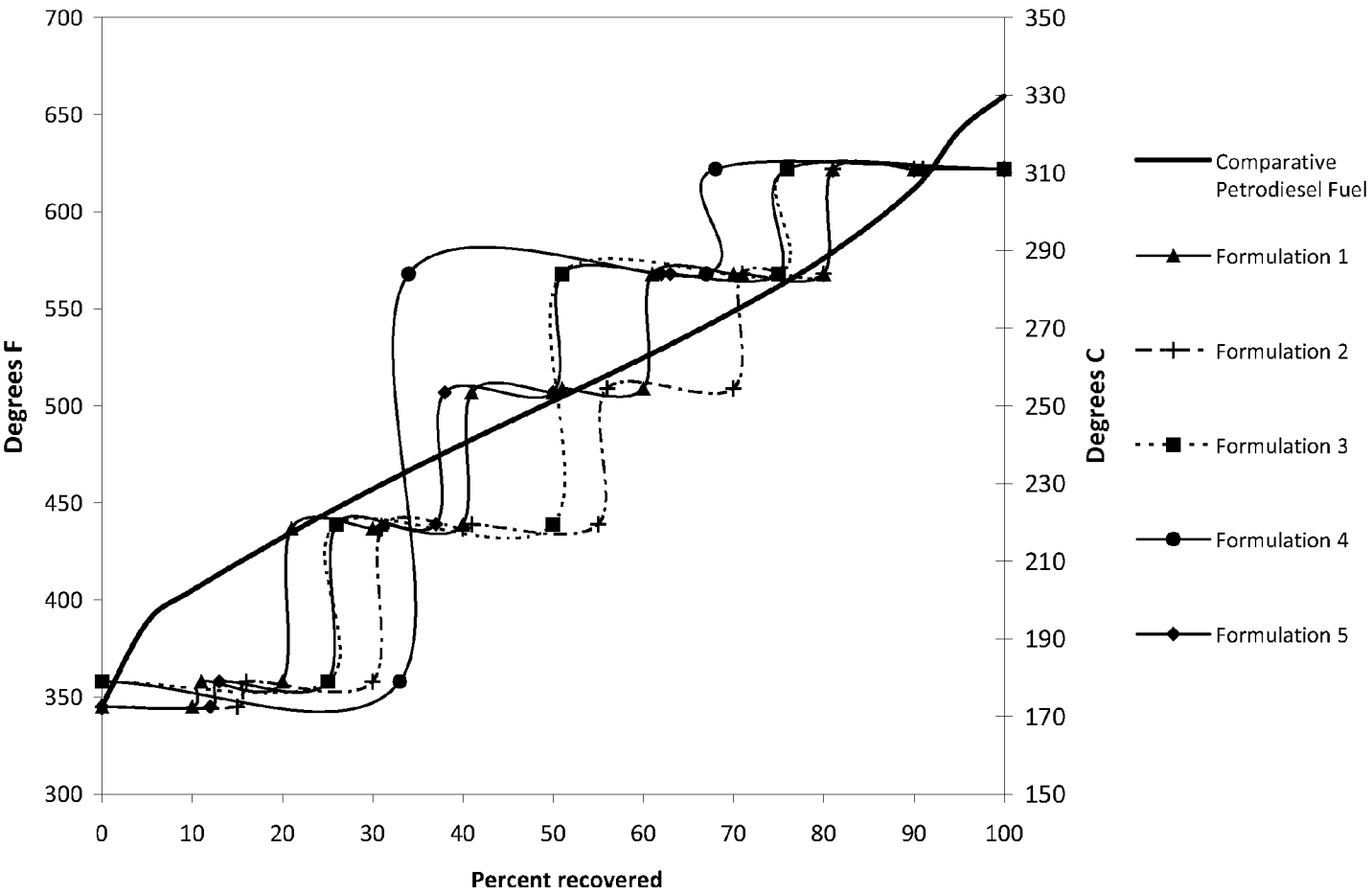

National Institute of Science and Technology Chemistry Web Book, Standard Reference Database No. 69, copyright 2008, printed on Oct. 21, 2009, http://webbook.nist.gov/cgi/cbook.cgi?Name=hexylbenzene&Units=SI.

National Institute of Science and Technology Chemistry Web Book, Standard Reference Database No. 69, copyright 2008, printed on Oct. 21, 2009, http://webbook.nist.gov/cgi/cbook.cgi?Name=hexylcyclohexane&Units=SI.

National Institute of Science and Technology Chemistry Web Book, Standard Reference Database No. 69, copyright 2008, printed on Oct. 21, 2009, http://webbook.nist.gov/cgi/cbook.cgi?Name=octylbenzene&Units=SI.

National Institute of Science and Technology Chemistry Web Book, Standard Reference Database No. 69, copyright 2008, printed on Oct. 21, 2009, http://webbook.nist.gov/cgi/cbook.cgi?Name=octylcyclohexane&Units=SI.

Taylor, Joshua D. et al., Compendium of Experimental Cetane Number Data, NREL/SR-540-36805 (Sep. 2004).

Technical Review, Diesel Fuels, Chevron Global Marketing (2008).

Yaws, Carl L., Yaws' Handbook of Thermodynamic and Physical Properties of Chemical Compounds, Knovel, retrieved from http://www.knovel.com/web/portal/basic_search/display?_EXT_KNOVEL_DISPLAY bookid=667 (Physical Properties of Refractive Index Table for Entry Nos. 573-decane, 596-decylbenzene, 597-decylcyodohexane, 1925-dodecylbenzene, 1926-dodecylcyclohexane, 308-butylcyclohexane, 2623-hexylbenzene, 2624-hexylcyclohexane, 3829-octylbenzene, 3830-octylcyclohexane) (copyright 2003, updated Nov. 22, 2004) (accessed online and printed on Sep. 15, 2009).

* cited by examiner

Comparison of Actual Average Diesel Fuel to Simulated Distillation Curves of Formulations 1-5

Comparison of Actual Average Diesel Fuel to Simulated Distillation Curves of Formulations 6-9

SYNTHETIC DIESEL FUEL COMPOSITIONS

FIELD

The present disclosure relates to diesel fuel compositions and more particularly to synthetic diesel fuel oil compositions and methods for making such synthetic diesel fuel compositions.

BACKGROUND

This section provides background information related to the present disclosure which is not necessarily prior art.

Diesel fuels derived from fossil fuel crude oil sources, e.g., petroleum-based fuels, typically include several hundred compounds. The specific compounds present in the diesel fuel are dependent on the crude oil and the refinery configuration resulting in different distillation profiles. However, many of the compounds in diesel fuel have undesirable properties. For example, paraffins, which are typically present in diesel fuels refined from petroleum-based crude oils, tend to have a desirably high cetane number, but at normal ambient temperatures tend to be in the undesirable form of a wax and have a low density. Polycyclic aromatics, also typically present in petroleum-based refined diesel fuels at high concentrations, produce particulate matter when combusted.

While synthetic diesel fuels have been produced by the Fischer-Tropsch method, such synthetic diesel fuels tend to be highly paraffinic, hence waxy and of low density, resulting in reduced fuel economy and poor cold temperature operability. Fischer-Tropsch fuels also have low aromatic content, which tends to result in undesirable seal shrinkage in internal combustion engines, which can potentially cause fuel leakage and other issues. Since Fischer-Tropsch synthetic diesel fuels suffer from high freeze points (resulting in poor cold temperature performance) and low density (resulting in a fuel economy loss), Fischer-Tropsch synthetic diesel fuels are practically useful only as fuel blending components. The present disclosure provides improved synthetic diesel fuels having superior performance as primary and sole sources of fuel for compression ignition combustion engine or motors. In certain aspects, the synthetic diesel fuels can be a biofuel obtained from a renewable resource, such as biological sources like animal or vegetable materials, and are thus regarded as being more "environmentally-friendly" than petroleum-based fuels.

SUMMARY

In various aspects, the present disclosure provides a synthetic diesel fuel composition. In various aspects, the synthetic diesel fuel composition comprises at least three $C_{10}$-$C_{18}$ hydrocarbon compounds. The synthetic diesel fuel composition comprises at least one aromatic hydrocarbon compound at greater than or equal to about 10 vol. % of the total composition. In various aspects, the synthetic diesel fuel composition has a cetane number of greater than 40, a freeze point of less than or equal to about −20° C. (about −4° F.), and a density of greater than or equal to about 0.81 g/ml (about 6.8 lb/gal).

In certain other aspects, a synthetic diesel fuel composition is provided by the present teachings that comprises at least three $C_{10}$-$C_{18}$ hydrocarbon compounds selected from the group consisting of decane, butylcyclohexane, hexylbenzene, hexylcyclohexane, octylbenzene, octylcyclohexane, decylbenzene, decylcyclohexane, dodecylbenzene, and dodecylcyclohexane. The synthetic diesel fuel composition comprises at least one aromatic hydrocarbon compound at greater than or equal to about 10 vol. % of the total composition. In certain aspects, the aromatic hydrocarbon compound is one of the at least three $C_{10}$-$C_{18}$ hydrocarbons. The synthetic diesel fuel composition has a cetane number of greater than or equal to about 42 and less than or equal to about 51, a freeze point of less than or equal to about −20° C. (about −4° F.), and a density of greater than or equal to about 0.81 g/ml, (about 6.8 lb/gal), and less than or equal to about 0.84 g/ml (about 7.0 lb/gal).

In yet other aspects, the present disclosure provides methods for formulating synthetic diesel fuel compositions. In certain aspects, the methods comprise admixing one or more $C_{10}$-$C_{18}$ hydrocarbon compounds selected from the group consisting of decane, butylcyclohexane, hexylbenzene, hexylcyclohexane, octylbenzene, octylcyclohexane, decylbenzene, decylcyclohexane, dodecylbenzene, and dodecylcyclohexane. The composition is formulated so that at least one aromatic hydrocarbon compound is present at greater than or equal to about 10 vol. %. In this manner, a synthetic diesel fuel mixture is formed having a cetane number of greater than 40, a freeze point of less than or equal to about −20° C. (about −4° F.), and a density of greater than or equal to about 0.81 g/ml (about 6.8 lb/gal).

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
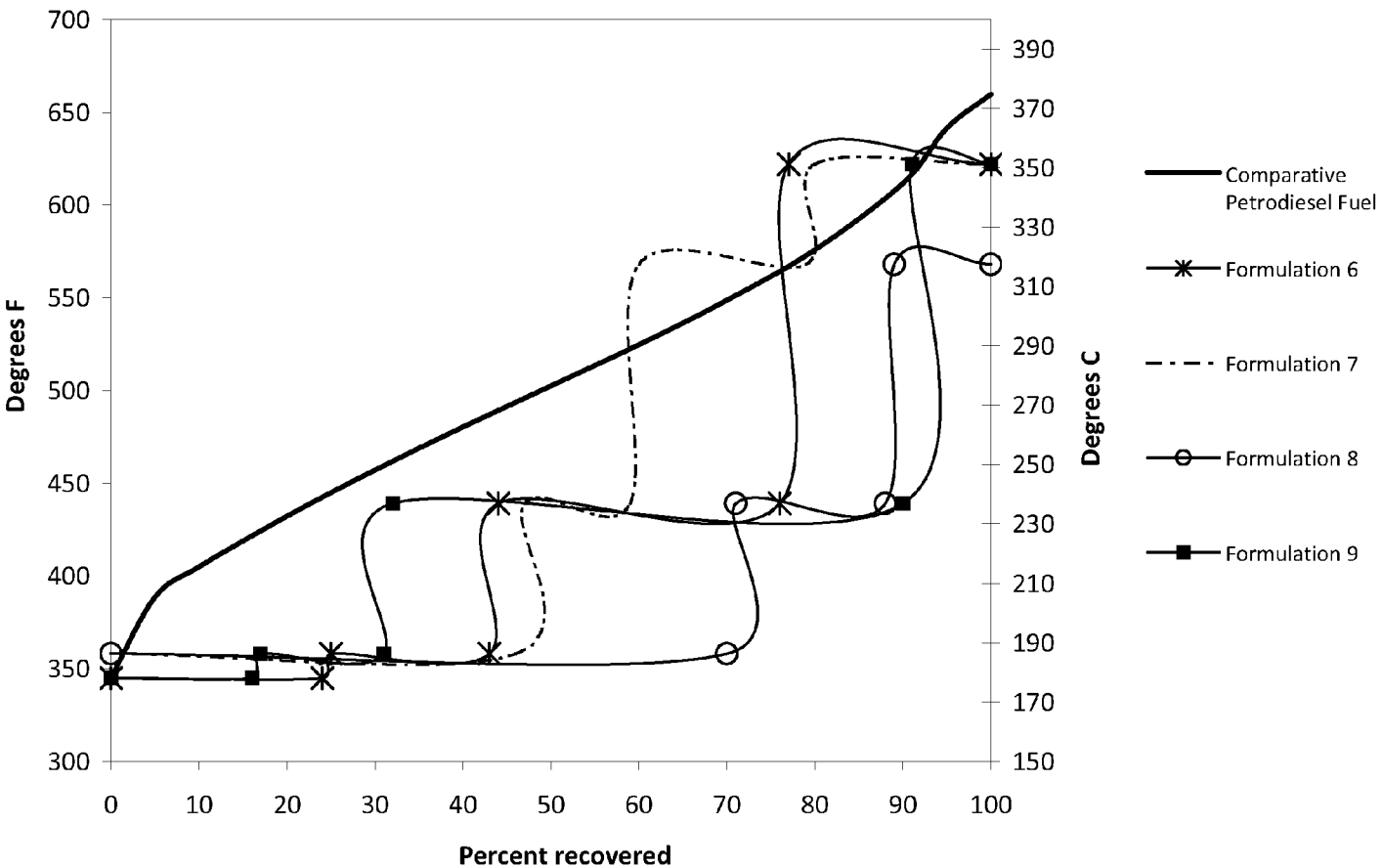

FIG. 1 is a comparative graph showing a conventional diesel fuel distillation curve compared with synthetic diesel fuel compositions formed in accordance with the present disclosure; and FIG. 2 is a comparative graph showing a conventional diesel fuel distillation curve compared with synthetic diesel fuel compositions formed in accordance with the present disclosure.

DETAILED DESCRIPTION

In various aspects, the present disclosure provides synthetic diesel fuel compositions and methods for formulating such synthetic diesel fuel compositions. In various aspects, the inventive synthetic diesel fuel compositions have desirable performance properties, which are equivalent and/or superior to diesel fuel or petrodiesel fractional distillates of refined petroleum crude oil, i.e., "conventional diesel fuel" or other known conventional synthetic diesel fuels, such as Fisher-Tropsch synthetic diesel fuels. Petroleum-based diesel fuels are a complex mixture of thousands of individual compounds, most with carbon numbers between about 10 and 22. A majority of these compounds fall into the paraffinic, naphthenic, or aromatic classes of hydrocarbons. Diesel fuels generally include any fuel that can be used in a compression ignition engine or the like, which typically have a boiling point range of about 200° C. (about 392° F.) to about 350° C. (about 662° F.). ASTM International Standard Specification for Diesel Fuel Oils D975 (Rev. December 2008) sets forth specifications for seven diesel fuel oil grades, including Grades 1-D (referred to herein interchangeably as Grade 1 diesel fuel oil or No. 1 diesel fuel), 2-D (e.g., Grade 2 or No. 2 diesel fuel oil), and 4-D (e.g., Grade 4 or No. 4 diesel fuel oil). Each ASTM specification or other reference citation described herein is expressly incorporated by reference in its entirety.

Grade 1 diesel fuels are special-purpose, light middle distillate fuel for use in diesel engine applications and have a higher volatility than Grade 2 fuels. Grade 1 diesel fuels have a maximum distillation temperature at 90% by volume of 288° C. (about 550° F.). Distillation temperatures can be determined by ASTM D86—Distillation of Petroleum Products or ASTM D2887—Boiling Range Distribution of Petroleum Fractions by Gas Chromatography, by way of non-limiting example. Grade 2 diesel fuels are general purpose, middle distillate fuels for use in diesel engine applications, particularly those encountering varying speeds and loads. Grade 2 diesel fuels have a minimum distillation temperature at 90% by volume of 282° C. (about 540° F.) and a maximum distillation temperature of 338° C. (about 640° F.). For safety Grade 1 has a minimum flash point of at least 38° C. (about 100° F.) and Grade D-2 has a minimum flash point of at least 52° C. (about 126° F.). Flash points can be measured by ASTM D93—Flash-Point by Pensky-Martens Closed Cup Tester.

However, for cold-weather use, Grades 1-D and 2-D may be combined per ASTM D975 with one another to reduce the cloud point to less than or equal to −12° C. (about 10° F.) for cold weather performance, as will be described in more detail below. Such a combination of blended Grades 1 and 2 may permissibly raise or lower certain other properties, including flash point. Diesel Fuel Grades 1-D and 2-D are further subclassified based on maximum sulfur content. Grade 4-D diesel fuel is a heavy distillate fuel for low and medium speed diesel engines, classified by high sulfur content, as well as other properties. In various aspects, the present disclosure pertains to a synthetic diesel fuel that are suitable replacements for and share properties and/or performance attributes of ASTM D975 Diesel Fuel Grades 1-D or 2-D.

In various aspects, the inventive synthetic diesel fuel compositions have a cetane number of greater than about 40. While North American diesel fuels typically have a cetane number of about 40, European diesel fuels tend to have a higher cetane number, typically equal to or greater than 51. Cetane number is defined by ASTM D975 as a measure of the ignition quality of the diesel fuel, which influences combustion roughness. The cetane number requirements depend on engine design, size, nature of speed and load variations, and on starting and atmospheric conditions. In all aspects, the cetane ratings for all Grades 1-D, 2-D, and 4-D set forth in ASTM D975 are a minimum of 40. ASTM D613 is a Standard Test Method for Cetane Number of Diesel Fuel Oil that defines a cetane number scale, where n-hexadecane or cetane provides a rating of 100 as part of the standard and heptamethylnonane is assigned a cetane rating of 15 for the lower end of the range of the standard. In ASTM D613, the cetane number of a diesel fuel is determined by comparing its ignition delay characteristics in a standard cooperative fuel research (CFR) test engine with those for blends of reference fuels of known cetane number(s). The compression ratio is varied by adjusting a hand calibrated wheel to obtain the same ignition delay for each sample and for each of two bracketing reference fuels, permitting interpolation of cetane numbers in terms of the hand wheel readings.

Cetane number can be measured in a variety of methods known to those of skill in the art, including Ignition Quality Tester (IQT) as set forth in ASTM D6890—Standard Test Method for Determination of Ignition Delay and Derived Cetane Number (DCN) or as measured by ASTM D613 described above. In other aspects, a calculated cetane index can be used to approximate fuel performance where a standard engine is unavailable for testing, for example, by ASTM D4737—Calculated Cetane Index by Four-Variable Equation (using the density of the fuel and the distillation temperatures at 10 vol. %, 50 vol. %, and 90 vol. % to estimate cetane number) and ASTM D976—Calculated Cetane Index of Distillate Fuels (which uses the density of the fuel and its mid-distillation temperature to estimate the cetane number), for example.

In various aspects, the synthetic diesel fuels of the present disclosure have a cetane number of greater than or equal to about 40. In certain aspects, the synthetic diesel fuels of the present teachings have a cetane number of at least about 40 and less than or equal to about 51. In certain aspects, the synthetic diesel fuel composition has a cetane number of greater than or equal to about 41; optionally greater than or equal to about 42; optionally greater than or equal to about 43; optionally greater than or equal to about 44; and in certain aspects greater than or equal to about 45. In yet other aspects, the synthetic diesel fuel compositions of the present disclosure have a cetane number of about 51. In certain aspects, the inventive synthetic diesel fuel compositions have a cetane number of less than or equal to about 51; optionally less than or equal to about 50; optionally less than or equal to about 49; optionally less than or equal to about 48; optionally less than or equal to about 47; optionally less than or equal to about 46. In certain aspects, the synthetic diesel fuel compositions of the present disclosure have a cetane number of greater than or equal to about 45.

Low temperature operability of diesel fuels can be particularly important, especially with middle distillate fuels, like Grade 2 diesel fuel, because such conventional petroleum-based fuels tend to contain relatively large amounts of straight and branched chain hydrocarbons that solidify at ambient winter temperatures in colder geographic regions. Wax formation can be exacerbated by blends of biodiesel with conventional diesel fuels and may plug the fuel filter or gel the fuel, creating fuel delivery issues within the engine. As noted above, it is permissible to mix Grade 1 diesel fuels, which has a lower wax content, with Grade 2 fuels in certain cold regions per ASTM D975. In certain aspects, related fuel composition properties that indicate the low temperature performance of the diesel fuel include low-temperature operability (ASTM D4539—Filterability of Diesel Fuels by Low-Temperature Flow Test (LTFT) —which is the minimum temperature at which 180 ml (about 11 $in^3$) of a sample can be filtered in one minute—and ASTM D6371—Cold Filter Plugging Point (CFPP) of Diesel and Fuel Heating Fuels—the highest temperature at which 20 ml (about 1 $in^3$) of fuel fails to pass through a 45 μm (about 0.0018 inches) wire mesh under 2 kPa (about 0.29 pounds per square inch (psi)) vacuum in less than 60 seconds). Similarly, a pour point temperature of a fuel composition is the lowest temperature at which sample movement occurs upon tilting.

In various aspects, the synthetic diesel fuel compositions of the present teachings have a freeze point of less than or equal to about −20° C. (about −4° F.). In certain variations, the freeze point of the synthetic diesel fuel compositions of the present disclosure is optionally less than or equal to about −25° C. (about −13° F.); optionally less than or equal to about −30° C. (about −22° F.), and in certain aspects, less than or equal to about −35° C. (about −31 ° F.). In certain diesel fuel compositions of the present teachings, the freeze point may designed to be an "ultra-low" freeze point, which is less than or equal to about −35° C. (about −31 ° F.); optionally less than or equal to about −40° C. (about −40° F.); optionally less than or equal to about −45° C. (about −49° F.); optionally less or equal to about −50° C. (about −58° F.); and in certain aspects, less than or equal to about −55° C. (about −67° F.).

In certain variations, the synthetic diesel fuel compositions of the present teachings have a cloud point of less than or equal to about −12° C. (about 10° F.). Cloud point defines the temperature at which a cloud or haze of wax crystals appears in the oil under prescribed test conditions which generally relates to the temperature at which wax crystals begin to precipitate from the fuel oil in use. Per ASTM D2500—Cloud Point of Petroleum Products, the temperature at which a haze is first observed is established to be the cloud point of a fuel. While freeze and cloud points are similar, they are measured under different test conditions and thus may not correlate to one another. Per ASTM D975, cloud point provides a basis for waiving other properties of diesel fuel.

In various aspects, the synthetic diesel fuel compositions of the present teachings have a density of greater than or equal to 0.81 g/ml (about 6.8 lb/gal). When all other fuel properties are unchanged, heating value per unit volume of fuel is directly proportional to fuel density. Hence, a fuel having a decreased density results in a decrease in fuel energy content and thus a decrease in fuel economy. A typical Grade 2 diesel fuel has a density at 15.6° C. (about 60° F.) of between about 0.82 and about 0.88 g/ml (about 6.8 to about 7.3 lb/gal). In various aspects, the synthetic diesel fuel compositions of the present teachings have a density of greater than or equal to 0.81 g/ml (about 6.8 lb/gal). In certain aspects, the density of the inventive diesel fuel composition is greater than or equal to about 0.81 g/ml (about 6.8 lb/gal) and less than or equal to about 0.85 g/ml (about 7.1 lb/gal). In certain variations, the inventive diesel fuel compositions optionally have a density of greater than or equal to about 0.82 g/ml (about 6.8 lb/gal); optionally greater than or equal to about 0.83 (about 6.9 lb/gal); and in certain aspects, from about 0.83 to about 0.84 g/ml (about 6.8 to about 7.0 lb/gal).

In various aspects, the inventive synthetic diesel fuel compositions comprise at least one aromatic hydrocarbon organic compound at greater than or equal to about 10 vol. % of the total composition. In certain non-limiting aspects, increasing the aromatic hydrocarbon content of the fuel composition increases density and thus heating value, but tends to reduce cetane number of the diesel fuel, since aromatics tend to have lower cetane numbers. Also, if the total content of the aromatic hydrocarbon component is too high, it may cause the diesel fuel composition to fall outside the specified distillation temperature range in ASTM D975. A minimum content of greater than or equal to about 10 vol. % of aromatic hydrocarbon compounds ensures low temperature operability, as reflected by a cloud point of less than or equal to about −12° C. (about 10° F.) and/or a freeze point temperature of less than or equal to about to about −20° C. (about −4° F.). In addition, the minimum content of aromatic hydrocarbon molecules at greater than or equal to about 10 vol. % ensures that seal shrinkage in fuel system components will not occur.

Hydrocarbons for fuel compositions comprise hydrogen and carbon, as used herein, typically include paraffins, naphthenes, olefins, and aromatics. Paraffins and naphthenes are typically saturated hydrocarbons, as where aromatic and olefins are unsaturated hydrocarbon compounds. Paraffins are saturated, typically linear hydrocarbons, having a general formula of $C_nH_{2n+2}$, including structural isomers, such as isoparaffins. Olefins are similar to paraffins, but have at least one unit of unsaturation (or a double-bond between carbon atoms) in the hydrocarbon chain. Olefins having a single unsaturated double-bond have the nominal general formula of $CnH_{2n}$. Olefins tend to be formed during refining processes or in synthetic processes, such as Fisher-Tropsch synthetic processes, for example. Naphthenes include cyclic ring structures, which in diesel fuels tend to include alkyl rings of 5 to 6 carbon atoms, optionally including fused ring structures with a linear hydrocarbon chain. Naphthenes having a single ring have the general formula $C_nH_{2n}$. Aromatics include hydrocarbons with aromatic ring structures, such as benzyl groups. A one-ring aromatic hydrocarbon compound has a general formula of $C_nH_{2n-6}$. Polycyclic aromatic compounds include those hydrocarbons having two or more aromatic rings, which may optionally be fused ring structures. Notably, compounds derived from crude petroleum oil or other natural sources may contain small amounts of heteroatoms, such as nitrogen, sulfur, oxygen, or phosphorus.

In various aspects, the inventive synthetic diesel fuel composition comprises at least three $C_{10}$-$C_{18}$ hydrocarbon compounds. Particularly suitable $C_{10}$-$C_{18}$ hydrocarbon compounds for use in the inventive diesel fuel compositions of the present disclosure include decane, butylcyclohexane, hexylbenzene, hexylcyclohexane, octylbenzene, octylcyclohexane, decylbenzene, decylcyclohexane, dodecylbenzene, and dodecylcyclohexane. The properties of each of these particularly suitable hydrocarbon compounds is set forth below in Table 1, as further detailed in Yaw's Handbook of Thermodynamic and Physical Property Properties of Chemical Compounds, by Carl L. Yaws, Knovel (2003); The Compendium of Experimental Cetane Number Data, NREL/SR-540-36805 (2004); Diesel Fuels Technical Review by Chevron Global Marketing, (2008); and National Institute of Science and Technology Chemistry Web Book, Standard Reference Database Number 69 (http://webbook.nist.gov/chemistry dated February 2009).

TABLE 1

| Hydrocarbon Compound | CAS Registry No. | Molecular Formula | Carbon No. | Molecular Weight (g/mol) | Density (g/ml) | Freeze Point Temp. (° C.) | Boiling Point Temp. (° C.) | Cetane number | Heat of Combustion (kJ/kg) |
|---|---|---|---|---|---|---|---|---|---|
| Decane | 124-18-5 | $C_{10}H_{22}$ | 10 | 142.285 | 0.728 | −30 | 174 | 76 | 44,315 |
| Decylbenzene | 104-72-3 | $C_{16}H_{26}$ | 10 | 218.382 | 0.852 | −75 | 181 | 46.5 | 43,496 |
| Decylcyclohexane | 1795-16-0 | $C_{16}H_{32}$ | 12 | 224.43 | 0.815 | −61 | 226 | 26 | 41,896 |
| Dodecylbenzene | 123-01-3 | $C_{18}H_{30}$ | 12 | 246.436 | 0.849 | −9 | 225 | 36 | 43,522 |
| Dodecylcyclohexane | 1795-17-1 | $C_{18}H_{36}$ | 14 | 252.484 | 0.819 | −36 | 265 | 30 | 42,159 |
| Butylcyclohexane | 1678-93-9 | $C_{10}H_{20}$ | 14 | 140.269 | 0.796 | −19 | 264 | 40 | 43,545 |
| Hexylbenzene | 1077-16-3 | $C_{12}H_{18}$ | 16 | 162.275 | 0.855 | −14 | 298 | 50 | 42,349 |
| Hexylcyclohexane | 4292-75-5 | $C_{12}H_{24}$ | 16 | 168.323 | 0.892 | −2 | 298 | 45 | 43,564 |
| Octylbenzene | 2189-60-8 | $C_{14}H_{22}$ | 18 | 190.329 | 0.853 | 3 | 328 | 50 | 42,503 |
| Octylcyclohexane | 1795-15-9 | $C_{14}H_{28}$ | 18 | 196.376 | 0.81 | 13 | 328 | 50 | 43,580 |

Combinations of these specific hydrocarbon compounds are selected, such that in combination, they provide the inventive diesel fuel compositions described above, having at a minimum a desired cetane number of greater than or equal to 40, a freeze point temperature of less than or equal to about to about −20° C. (about −4° F.), and density of greater than or equal to about 0.81 g/ml (about 6.8 lb/gal). Generally, the $C_{10}$-$C_{18}$ hydrocarbon compounds particularly suitable for use in the inventive synthetic diesel fuel compositions of the disclosure have a boiling point in the range 170-330° C., (about 338-626° F.), corresponding to the diesel fuel distillation curve range. In alternate aspects, the inventive synthetic diesel fuel composition may comprise a similar or equivalent hydrocarbon compound selected such that when it is mixed with other hydrocarbon compounds will provide a diesel fuel having a boiling point in the range of about 170° C. to about 330° C. (about 338° F. to about 626° F.), a cetane number of greater than 40, a freeze point temperature of less than or equal to about −20° C. (about −4° F.) and a density of greater than or equal to about 0.81 g/ml (about 0.47 oz/in$^3$).

In certain aspects, at least three of these $C_{10}$-$C_{18}$ hydrocarbon compounds are selected so that in combination with each other, they provide a synthetic diesel fuel composition which is similar to a diesel fuel Grade 1-D having a cetane number of greater than or equal to about 45, a density of at least 0.81 g/ml (about 6.8 lb/gal) and a freeze point temperature of less than −20° C. (about −4° F.). In yet other embodiments, at least three of these $C_{10}$-$C_{18}$ hydrocarbon compounds are selected so that in combination with each other, they provide a synthetic diesel fuel composition which is similar to a diesel fuel Grade 2-D having a cetane number of greater than or equal to about 45, a density of at least 0.82 g/ml (about 6.8 lb/gal) and a freeze point temperature of less than −20° C. (about −4° F.). In various aspects, the selection of at least three of more of these particular compounds avoids the problems associated with Fischer-Tropsch synthetic diesel fuels, which have high freeze temperature points (resulting in poor cold temperature properties) and low densities (resulting in a fuel economy loss).

Additionally, the inventive synthetic diesel fuel compositions contain at least 10% by volume of aromatic hydrocarbons, which minimizes any issues with seal shrinkage, to which Fisher-Tropsch fuels are also susceptible. An aromaticity test can indicate the aromatics content of diesel fuel per ASTM D975, particularly of concern for potential negative impact on emissions, per U.S. Regulations (40 Code of Federal Regulations Part 80). In certain aspects, the aromatic hydrocarbon comprises an aromatic hydrocarbon or aryl group, such as a phenyl or a benzyl group. In certain aspects, such an aromatic hydrocarbon compound is one of the $C_{10}$-$C_{18}$ hydrocarbons described above. Thus, particularly suitable aromatic $C_{10}$-$C_{18}$ hydrocarbons for the synthetic diesel fuel compositions of the present disclosure include hexylbenzene, octylbenzene, decylbenzene, and/or dodecylbenzene. In certain variations, the one or more aromatic hydrocarbon compounds are collectively present in the inventive diesel fuel composition at greater than or equal to about 10 vol. % and less than or equal to about 60 vol. %, optionally at greater than or equal to about 15 vol. % to less than or equal to about 50 vol. %, optionally at greater than or equal to about 20 vol. % to less than or equal to about 40 vol. % of the total fuel composition.

In various aspects, at least three of the $C_{10}$-$C_{18}$ hydrocarbon compounds selected from the group decane, butylcyclohexane, hexylbenzene, hexylcyclohexane, octylbenzene, octylcyclohexane, decylbenzene, decylcyclohexane, dodecylbenzene, and/or dodecylcyclohexane are selected to formulate the inventive synthetic diesel fuel compositions. In certain aspects, at least three of the $C_{10}$-$C_{18}$ hydrocarbon compounds are selected from the group butylcyclohexane, hexylcyclohexane, decylbenzene, and/or dodecylcyclohexane.

In yet other variations, the synthetic diesel fuel compositions comprise at least four $C_{10}$-$C_{18}$ hydrocarbon compounds selected from the group consisting of: decane, butylcyclohexane, hexylbenzene, hexylcyclohexane, octylbenzene, octylcyclohexane, decylbenzene, decylcyclohexane, dodecylbenzene, and dodecylcyclohexane. In certain aspects, the synthetic diesel fuel compositions comprise five, optionally six, optionally seven, optionally eight, optionally nine, and in certain embodiments, every one of the $C_{10}$-$C_{18}$ hydrocarbon compounds selected from the group consisting of: decane, butylcyclohexane, hexylbenzene, hexylcyclohexane, octylbenzene, octylcyclohexane, decylbenzene, decylcyclohexane, dodecylbenzene, and dodecylcyclohexane.

Thus, in accordance with the present teachings, a synthetic fuel composition can have up to ten $C_{10}$-$C_{18}$ hydrocarbon compounds to allow blending and formulation of a diesel fuel having consistent quality and distillation curves similar to conventional petroleum diesel fuels to provide similar performance in a compression diesel engine, including robust cold start performance, while retaining desirable fuel economy. While more than ten such $C_{10}$-$C_{18}$ hydrocarbon compounds are possible and contemplated by the present teachings, it has been found that a synthetic diesel fuel composition having from three to ten of these particular hydrocarbon compounds sufficiently simulate the required distillation, physical properties, and performance attributes of petrodiesel fuel having hundreds of hydrocarbon species. In certain preferred aspects, the synthetic diesel fuel compositions do not have more than about fifty $C_{10}$-$C_{18}$ compounds, even more preferably are limited to less than about twenty-five $C_{10}$-$C_{18}$ hydrocarbon compounds, and in certain aspects have ten or fewer compounds described and listed above.

Depending on how many $C_{10}$-$C_{18}$ hydrocarbon compounds are selected for the diesel fuel composition of the present teachings, each respective compound may be present anywhere from greater than or equal to about 1 vol. % to less than or equal to about 75 vol. %. In certain embodiments, each respective C10-$C_{18}$ hydrocarbon compound is optionally present in the diesel fuel composition at greater than or equal to about 1 vol. % to less than or equal to about 70 vol. %, optionally at greater than or equal to about 3 vol. % to less than or equal to about 65 vol. %, optionally at greater than or equal to about 5 vol. % to less than or equal to about 55 vol. %, optionally at greater than or equal to about 7 vol. % to less than or equal to about 50 vol. %. In certain variations, each respective C10-$C_{18}$ hydrocarbon compound is optionally present in the diesel fuel composition at greater than or equal to about 10 vol. % to less than or equal to about 35 vol. %; optionally at less than or equal to about 34 vol. %.

Formulations 1-5 provided in TABLE 2 below are non-limiting examples of suitable synthetic fuels prepared in accordance with the present teachings.

TABLE 2

| Compound | Formulation 1 Vol. % | Formulation 1 Freeze Point (° C.)* | Formulation 1 Cetane No.* | Formulation 1 Density* (g/ml) | Formulation 2 Vol. % | Formulation 2 Freeze Point (° C.)* | Formulation 2 Cetane No.* | Formulation 2 Density* (g/ml) |
|---|---|---|---|---|---|---|---|---|
| Decane | 10 | −3 | 7.6 | 0.073 | 15 | −4.5 | 11.4 | 0.1095 |
| Butylcyclohexane | 10 | −7.5 | 4.65 | 0.079 | 15 | −11.25 | 6.975 | 0.1185 |
| Hexylbenzene | 10 | −6.1 | 2.6 | 0.084 | 10 | −6.1 | 2.6 | 0.084 |
| Hexylcyclohexane | 10 | −0.9 | 3.6 | 0.088 | 15 | −1.35 | 5.4 | 0.132 |
| Octylbenzene | 10 | −3.6 | 3 | 0.085 | 15 | −5.4 | 4.5 | 0.1275 |
| Octylcyclohexane | 10 | −1.9 | 4 | 0.08 | 0 | 0 | 0 | 0 |
| Decylbenzene | 10 | −1.4 | 5 | 0.084 | 10 | −1.4 | 5 | 0.084 |
| Decylcyclohexane | 10 | −0.2 | 4.5 | 0.081 | 0 | 0 | 0 | 0 |
| Dodecylbenzene | 10 | 0.3 | 5 | 0.084 | 10 | 0.3 | 5 | 0.084 |
| Dodecylcyclohexane | 10 | 1.3 | 5 | 0.081 | 10 | 1.3 | 5 | 0.081 |
| Total | 100 | −23 | 45 | 0.819 | 100 | −28.4 | 45.9 | 0.821 |

| Compound | Formulation 3 Vol. % | Formulation 3 Freeze Point (° C.)* | Formulation 3 Cetane No.* | Formulation 3 Density* (g/ml) | Formulation 4 Vol. % | Formulation 4 Freeze Point (° C.)* | Formulation 4 Cetane No.* | Formulation 4 Density* (g/ml) |
|---|---|---|---|---|---|---|---|---|
| Decane | 0 | 0 | 0 | 0 | 0 | 0 | 0 | 0 |
| Butylcyclohexane | 25 | −18.75 | 11.625 | 0.1975 | 33 | −24.75 | 15.345 | 0.2607 |
| Hexylbenzene | 0 | 0 | 0 | 0 | 0 | 0 | 0 | 0 |
| Hexylcyclohexane | 25 | −2.25 | 9 | 0.22 | 0 | 0 | 0 | 0 |
| Octylbenzene | 0 | 0 | 0 | 0 | 0 | 0 | 0 | 0 |
| Octylcyclohexane | 0 | 0 | 0 | 0 | 0 | 0 | 0 | 0 |
| Decylbenzene | 25 | −3.5 | 12.5 | 0.21 | 34 | −4.76 | 17 | 0.2856 |
| Decylcyclohexane | 0 | 0 | 0 | 0 | 0 | 0 | 0 | 0 |
| Dodecylbenzene | 0 | 0 | 0 | 0 | 33 | 0.99 | 16.5 | 0.2772 |
| Dodecylcyclohexane | 25 | 3.25 | 12.5 | 0.2025 | 0 | 0 | 0 | 0 |
| Total | 100 | −21.3 | 45.6 | 0.83 | 100 | −28.5 | 48.8 | 0.824 |

| Compound | Formulation 5 Vol. % | Formulation 5 Freeze Point (° C.)* | Formulation 5 Cetane No.* | Formulation 5 Density* (g/ml) |
|---|---|---|---|---|
| Decane | 12 | −3.6 | 9.12 | 0.0876 |
| Butylcyclohexane | 13 | −9.75 | 6.045 | 0.1027 |
| Hexylbenzene | 0 | 0 | 0 | 0 |
| Hexylcyclohexane | 12 | −1.08 | 4.32 | 0.1056 |
| Octylbenzene | 13 | −4.68 | 3.9 | 0.1105 |
| Octylcyclohexane | 0 | 0 | 0 | 0 |
| Decylbenzene | 12 | −1.68 | 6 | 0.1008 |
| Decylcyclohexane | 13 | −0.26 | 5.85 | 0.1053 |
| Dodecylbenzene | 25 | 0.75 | 12.5 | 0.21 |
| Dodecylcyclohexane | 0 | 0 | 0 | 0 |
| Total | 100 | −20.3 | 47.7 | 0.823 |

*Calculated Values

Formulation 1 contains every one of the ten $C_{10}$-$C_{18}$ hydrocarbon compounds selected from the group consisting of decane, butylcyclohexane, hexylbenzene, hexylcyclohexane, octylbenzene, octylcyclohexane, decylbenzene, decylcyclohexane, dodecylbenzene, and dodecylcyclohexane, each respectively present at 10 volume %. The total amount of aromatic compounds in the fuel composition includes hexylbenzene, octylbenzene, decylbenzene, and dodecylbenzene at 40 vol. %. The resultant freeze point temperature is calculated to be about −23° C., (about −9.4° F.), the cetane number is calculated to be 45, and the density is calculated to be 0.819 g/ml (about 6.83 lb/gal). Formulation 2 has about 15 vol. % of decane, 15 vol. % of butylcyclohexane, 10 vol. % of hexylbenzene, 15 vol. % of hexylcyclohexane, 15 vol. % of octylbenzene, 10 vol. % of decylbenzene, and 10 vol. % of dodecylbenzene and dodecylcyclohexane, respectively. The total aromatic organic compounds are cumulatively present in the composition at 45 vol. % (hexylbenzene, octylbenzene, decylbenzene, and dodecylbenzene). The synthetic diesel fuel Formulation 2 has a calculated freeze point temperature of −28.4° C. (about −19.1 ° F.), a calculated cetane number of 45.9, and a calculated density of about 0.821 g/ml (about 6.85 lb/gal).

Synthetic diesel fuel Formulation 3 has 25 vol. % of butylcyclohexane, 25 vol. % of hexylcyclohexane, 25 vol. % of decylbenzene, and lastly 25 vol. % of dodecylcyclohexane, resulting in a diesel fuel composition having total aromatic compounds present at 25 vol. %, with a calculated freeze point temperature of −21.3° C. (about −6.34° F.) a calculated cetane number of 45.6, and a calculated density of about 0.83 g/ml (about 6.9 lb/gal). Formulation 4 has butylcyclohexane at 33 vol. %, decylbenzene at 34 vol. %, and dodecylbenzene at 33 vol. %. Total aromatic compound volume concentration in the synthetic diesel fuel composition is 67 vol. %. Formulation 4 has a calculated freeze point temperature of −28.5° C. (about −19.3° F.), a calculated cetane number of 48.8, and a calculated density of about 0.824 g/ml (about 6.87 lb/gal).

Lastly, synthetic diesel fuel Formulation 5 contains 12 vol. % of decane, 13 vol. % of butylcyclohexane, 12 vol. % of hexylcyclohexane, 13 vol. % of octylbenzene, 12 vol. % of decylbenzene, 13 vol. % of decylcyclohexane, and 25 vol. % of dodecylbenzene. The total aromatic compound content of Formulation 5 is 50 vol. % (octylbenzene, decylbenzene, and dodecylbenzene). Formulation 5 has a calculated freeze point temperature of −20.3° C. (about −4.54° F.) a calculated cetane number of 47.7, and a calculated density of about 0.823 g/ml (about 0.476 oz/in$^3$). As noted above, Formulations 1-5 are suitable equivalents to petrodiesel refined from petroleum based diesel fuel oil.

Diesel fuel volatility requirements ultimately depend on engine design, size, nature of speed and load variations, and starting and atmospheric conditions. For engines that are operated with rapidly fluctuating loads and speeds as in bus and truck operation, more volatile fuels may provide best performance, particularly with respect to emissions. However, better fuel economy is generally obtained from the heavier types of fuels because of their higher heat content. The volatility of a diesel fuel can be determined by its distillation profile. In FIG. 1, a conventional petroleum refined summer Grade 2-D diesel fuel distillation curve is compared with the predicted distillation curves of the inventive synthetic diesel fuels described as Formulations 1-5, above.

As can be seen, the comparative conventional Grade 2-D diesel fuel begins to volatilize at around 350° F. (about 171° C.) and 90% by volume is recovered at about 625° F. (about 330° C.). This average distillation data for Grade 2-D diesel fuel comes from the Summer 2008 Alliance of Automobile Manufacturers North American Diesel Fuel Survey, based upon on data from 150 samples collected across the United States. Distillation was conducted according to ASTM D86—Distillation of Petroleum Products. The synthetic diesel fuel Formulations 1-5 of the present disclosure also begin to volatilize in the range of 340-360° F. (about 171-182° C.) and 90% by volume are volatilized by about 625° F. (about 330° C.), as well. This approximation of the synthetic diesel fuels of the present disclosure to the petrodiesel fuel distillation curve provides sufficient performance to substitute for the conventional diesel fuels. For example, adequate lower temperature volatilization impacts cold start performance (ensuring adequate volatilization for combustion at low temperatures), while ensuring a range of hydrocarbons having boiling points ranging in the higher temperatures to increase density and thus augment fuel content values and thus fuel economy. Thus, in certain aspects, various compounds selected for the synthetic diesel fuel compositions boil in the specified diesel fuel range. Notably, the present disclosure contemplates the inventive synthetic diesel fuel compositions further containing conventional diesel fuel additives, which are not included in these exemplary compositions.

Thus, in various aspects of the present disclosure, a synthetic diesel fuel composition is provided that comprises at least three $C_{10}$-$C_{18}$ hydrocarbon compounds selected from the group consisting of decane, butylcyclohexane, hexylbenzene, hexylcyclohexane, octylbenzene, octylcyclohexane, decylbenzene, decylcyclohexane, dodecylbenzene, and dodecylcyclohexane. The synthetic diesel fuel composition comprises at least one aromatic hydrocarbon compound at greater than or equal to about 10 vol. % of the total composition. Further, the synthetic diesel fuel composition has a cetane number of greater than 40, a freeze point of less than or equal to about −20° C. (about −4° F.), and a density of greater than or equal to about 0.81 g/ml (about 6.8 lb/gal).

In general, the synthetic diesel fuel formulations of the present disclosure are suitable for use in compression ignition engines. Specifically, in certain embodiments, the formulations contain essentially zero sulfur and meet the U.S., European, or other governmental requirements for ultra low sulfur diesel fuel (in the U.S. less than about 15 mg/kg maximum sulfur). Thus, such fuels are low in sulfur, so that the fuels also meet the copper strip corrosion limit in D975 (which measures reactive sulfur compounds in the fuel). The synthetic fuels can meet the aromaticity requirement if total aromatics are below 35 vol. % or cetane index is above 40, which uses density and 50% evaporated distillation temperature. In various aspects, the formulations contain minimal or no inorganic elements to meet the ash limit. In various aspects, the flash point requirement is also met by the synthetic fuel formulations of the present teachings.

Other exemplary formulations prepared in accordance with the present teachings are provided in Table 3. Formulation 6 has a relatively high calculated cetane number of about 51, with a corresponding freeze point temperature of −23.7° C. (about −10.7° F.) and a calculated density of about 0.817. Formulation 6 contains 24 vol. % decane, 19 vol. % butylcyclohexane, 33 vol. % hexylcyclohexane, and 24 vol. % dodecylbenzene (an aromatic compound).

Formulation 7 has a relatively low freeze point temperature calculated to be about −35.7° C. (about −32.3° F.) that makes it particularly suitable as a cold temperature synthetic diesel fuel composition. The cetane number is about 46.6 and the density is 0.816 g/ml (about 6.81 lb/gal). Synthetic diesel fuel Formulation 7 contains 46 vol. % butylcyclohexane, 13 vol. % hexylcyclohexane, 20 vol. % decylbenzene (aromatic compound), and 21 vol. % of dodecylcyclohexane. Formulation 9 is an "ultra-low" freeze point temperature synthetic diesel fuel composition having a calculated freeze point of about −55.8° C. (about −68.4° F.). It contains 70 vol. % butylcyclohexane, 18 vol. % hexylcyclohexane, and 12 vol. % decylbenzene (aromatic compound).

Lastly, Formulation 8 in Table 3 is a synthetic diesel fuel composition prepared in accordance with the present disclosure that has a relatively high density of about 0.839 g/ml (about 7.00 lb/gal). It contains 16 vol. % decane, 15 vol. % butylcyclohexane, 59 vol. % hexylcyclohexane, and 10 vol. % dodecylbenzene (aromatic compound). It has a cetane number calculated to be about 45.4 and a freeze point temperature of −21.1° C., (about −5.9° F.), in accordance with the present teachings.

In FIG. 2, inventive Formulations 6-8 are compared with a conventional Grade 2-D diesel fuel of the same composition used in FIG. 1, described above. Conventional Grade 2-D diesel fuel begins to volatilize at around 350° F. (about 171° C.) and 90% by volume is recovered at about 625° F. (about 330° C.). Formulations 6-8 each have distillation curves with boiling points that range from 340° F. (about 171 ° C.) to about 625-635° F. (about 329-335° C.).

TABLE 3

| Compound | Formulation 6 Vol. % | Formulation 6 Freeze Point (° C.)* | Formulation 6 Cetane No.* | Formulation 6 Density* (g/ml) | Formulation 7 Vol. % | Formulation 7 Freeze Point (° C.)* | Formulation 7 Cetane No.* | Formulation 7 Density* (g/ml) |
|---|---|---|---|---|---|---|---|---|
| Decane | 24 | −7.2 | 18.2 | 0.175 | 0 | 0 | 0 | 0 |
| Butylcyclohexane | 19 | −14.3 | 8.8 | 0.150 | 46 | −34.5 | 21.4 | 0.363 |
| Hexylbenzene | 0 | 0 | 0 | 0 | 0 | 0 | 0 | 0 |
| Hexylcyclohexane | 33 | −3.0 | 11.9 | 0.290 | 13 | −1.2 | 4.7 | 0.114 |
| Octylbenzene | 0 | 0 | 0 | 0 | 0 | 0 | 0 | 0 |
| Octylcyclohexane | 0 | 0 | 0 | 0 | 0 | 0 | 0 | 0 |
| Decylbenzene | 0 | 0 | 0 | 0 | 20 | −2.8 | 10.0 | 0.168 |
| Decylcyclohexane | 0 | 0 | 0 | 0 | 0 | 0 | 0 | 0 |
| Dodecylbenzene | 24 | 0.7 | 12.0 | 0.202 | 0 | 0 | 0 | 0 |
| Dodecylcyclohexane | 0 | 0 | 0 | 0 | 21 | 2.7 | 10.5 | 0.170 |
| Total | 100 | −23.7 | 51.0 | 0.817 | 100 | −35.7 | 46.6 | 0.816 |

| Compound | Formulation 8 Vol. % | Formulation 8 Freeze Point (° C.)* | Formulation 8 Cetane No.* | Formulation 8 Density* (g/ml) | Formulation 9 Vol. % | Formulation 9 Freeze Point (° C.)* | Formulation 9 Cetane No.* | Formulation 9 Density* (g/ml) |
|---|---|---|---|---|---|---|---|---|
| Decane | 16 | −4.8 | 12.2 | 0.117 | 0 | 0 | 0 | 0 |
| Butylcyclohexane | 15 | −11.3 | 7.0 | 0.119 | 70 | −52.5 | 32.6 | 0.553 |
| Hexylbenzene | 0 | 0 | 0 | 0 | 0 | 0 | 0 | 0 |
| Hexylcyclohexane | 59 | −5.3 | 21.2 | 0.519 | 18 | −1.6 | 6.5 | 0.158 |
| Octylbenzene | 0 | 0 | 0 | 0 | 0 | 0 | 0 | 0 |
| Octylcyclohexane | 0 | 0 | 0 | 0 | 0 | 0 | 0 | 0 |
| Decylbenzene | 0 | 0 | 0 | 0 | 12 | −1.7 | 6.0 | 0.101 |
| Decylcyclohexane | 0 | 0 | 0 | 0 | 0 | 0 | 0 | 0 |
| Dodecylbenzene | 10 | 0.3 | 5.0 | 0.084 | 0 | 0 | 0 | 0 |
| Dodecylcyclohexane | 0 | 0 | 0 | 0 | 0 | 0 | 0 | 0 |
| Total | 100 | −21.1 | 45.4 | 0.839 | 100 | −55.8 | 45.0 | 0.812 |

*Calculated Values

In certain aspects, the synthetic diesel fuel compositions may consist essentially of three or more of the $C_{10}$-$C_{18}$ hydrocarbon compounds selected from the group consisting of: decane, butylcyclohexane, hexylbenzene, hexylcyclohexane, octylbenzene, octylcyclohexane, decylbenzene, decylcyclohexane, dodecylbenzene, and dodecylcyclohexane. Such a synthetic diesel fuel composition may further consist essentially of other conventional diesel fuel additives or diluents commonly present in diesel fuel compositions. Conventional diesel fuel additives include antioxidants, biocides, cetane improvers, cold flow improvers, corrosion inhibitors, detergents, and lubricity improvers. Respective concentrations of such additives are typically about 0.0001-0.1 mass %. In yet other aspects, the synthetic diesel fuel compositions of the present teachings can be combined and blended with biodiesel or other alternative or conventional fuels at various levels.

As discussed above, the synthetic diesel fuel compositions optionally include conventional diesel fuel additives. Available fuel additives can improve the suitability of diesel fuels for long-term storage and enhance thermal stability. As noted above, such conventional additives may include antioxidant packages, detergents, friction reducers, anti-wear additives and/or lubricity enhancing agents, corrosion inhibitors, cetane improvers, cold flow improvers, biocides or biostats (which destroy or inhibit the growth of fungi and bacteria), non-metallic dispersants, non-metallic detergents, corrosion and rust inhibitors, metal deactivators, defoamants, dyes, markers, antistatic additives, combustion enhancers, and combinations thereof, by way of non-limiting example. Such additives may be used in amounts well known to those of skill in the art, and may be collectively present at about 0.01 to about 1 weight % of the total diesel fuel composition, optionally at about 0.0001 to about 0.1 weight % of the total fuel mixture, by way of non-limiting example.

In yet other aspects, the present disclosure provides methods for formulating synthetic diesel fuel compositions, as described above. In certain aspects, the methods comprise admixing at least three $C_{10}$-$C_{18}$ hydrocarbon compounds selected from the group consisting of decane, butylcyclohexane, hexylbenzene, hexylcyclohexane, octylbenzene, octylcyclohexane, decylbenzene, decylcyclohexane, dodecylbenzene, and dodecylcyclohexane. In other aspects, prior to the admixing, the methods of formulating may include the step of selecting one or more of the $C_{10}$-$C_{18}$ hydrocarbon compounds selected from the group consisting of decane, butylcyclohexane, hexylbenzene, hexylcyclohexane, octylbenzene, octylcyclohexane, decylbenzene, decylcyclohexane, dodecylbenzene, and dodecylcyclohexane, based on cetane number, freeze point temperature, density, boiling point, and/or fuel value.

The composition is formulated so that at least one aromatic hydrocarbon compound is present at greater than or equal to about 10 vol. %, as described in the formulations above. In other aspects, admixing comprises adding one or more of the $C_{10}$-$C_{18}$ hydrocarbon compounds respectively at about 1 to 75% by volume. In other variations, the one or more of the $C_{10}$-$C_{18}$ hydrocarbon compounds are optionally respectively present in the diesel fuel composition at greater than or equal to about 1 vol. % to less than or equal to about 70 vol. %, optionally at greater than or equal to about 3 vol. % to less than or equal to about 65 vol. %, optionally at greater than or equal to about 5 vol. % to less than or equal to about 55 vol. %, optionally at greater than or equal to about 7 vol. % to less than or equal to about 50 vol. %. In certain variations, each respective C10-$C_{18}$ hydrocarbon compound is optionally present and admixed into the diesel fuel composition at greater than or equal to about 10 vol. % to less than or equal to about 35 vol. %.

In this manner, a synthetic diesel fuel mixture is formed having a cetane number of greater than 40, a freeze point of less than or equal to about −20° C. (about −4° F.), and a density of greater than or equal to about 0.81 g/ml (about 6.8 lb/gal). In preferred aspects, the synthetic diesel fuel composition comprising the preselected $C_{10}$-$C_{18}$ hydrocarbon compounds has a cloud point of at least about −12° C. (about 10° F.). In various aspects, the synthetic diesel fuels of the present disclosure meet the requirements found in ASTM D975 or may meet future standards to be developed by ASTM or other regulation or standard setting agencies. The inventive synthetic diesel fuels offer greater consistency in formulation/composition and provide greater design advantages. For example, resultant vehicle emissions systems can be better tailored to such fuels and provide improved emissions abatement. In certain aspects, the synthetic diesel fuel compositions are admixed with one or more conventional diesel fuel additives at the concentrations discussed above. Thus, admixing of the components for the synthetic fuel composition may further include adding one or more conventional diesel fuel additives selected from the group consisting of: antioxidant packages, detergents, friction reducers, anti-wear additives and/or lubricity enhancing agents, corrosion inhibitors, cetane improvers, cold flow improvers, biocides or biostats (which destroy or inhibit the growth of fungi and bacteria), non-metallic dispersants, non-metallic detergents, corrosion and rust inhibitors, metal deactivators, defoamants, dyes, markers, antistatic additives, combustion enhancers, and combinations thereof.

The particularly suitable $C_{10}$-$C_{18}$ compounds for use in the synthetic diesel fuel compositions of the present disclosure can be provided from conventional sources, which may include synthetic compounds or compounds isolated from a refining process, as distinguished from a conventional diesel fuel oil that is wholly created from refining crude oil and includes hundreds of hydrocarbon compounds. In certain variations, one or more of the $C_{10}$-$C_{18}$ hydrocarbon compounds are formed from non-petroleum sources generated from a biological, renewable, or natural source, which create a synthetic diesel composition in accordance with the present disclosure that is a so-called "biofuel" or "alternative fuel." Genetically engineered microbes can be tailored to produce the $C_{10}$-$C_{18}$ hydrocarbon compounds from biomass, plant sources, such as vegetable oils, like soybean oil, canola or hemp oil, or from animal sources, like animal fats, by way of non-limiting example. Other alternative fuels include biofuels made from plant-sources, including grains like corn, barley, sorghum, and wheat, which can be broken down and processed to form compounds for use as fuels. Other non-limiting sources of biofuels are cellulose-based and/or lignocellulose-based plant matter, like switch grass, corn stalks, wheat stalks, agricultural, municipal, paper industry, and forestry waste products. Furthermore, in certain aspects, synthetic diesel fuels prepared in accordance with the present teachings that are derived from biomass can be combined with biodiesel to make a biofuel composition. All these fuels have reduced $CO_2$ emissions compared to conventional diesel fuels.

The present teachings desirably provide synthetic diesel fuel compositions that are primary fuels (rather than blending agents), which can desirably be tailored to have superior properties and performance, including designing diesel fuel cetane number, density, freeze point, and the like. The inventive synthetic diesel fuel compositions comprise at least three and optionally up to ten $C_{10}$-$C_{18}$ hydrocarbon compounds discussed above to provide consistent, reliable, and predictable fuel performance. These inventive synthetic diesel fuel compositions desirably avoid problems associated with crude petroleum oil diesel and Fischer-Tropsch fuels, including fuel composition variability and reducing the presence of waxy and low density hydrocarbon components to improve low temperature performance and to reduce seal shrinkage issues. Furthermore, the inventive synthetic diesel fuel compositions are particularly well suited to be derived from alternative non-petroleum based fuel sources, like biomass derived alternative fuels created by microbial synthesis.

What is claimed is:

1. A synthetic diesel fuel composition comprising at least three $C_{10}$-$C_{18}$ hydrocarbon compounds selected from the group consisting of: decane, butylcyclohexane, hexylbenzene, hexylcyclohexane, octylbenzene, octylcyclohexane, decylbenzene, decylcyclohexane, dodecylbenzene, and dodecylcyclohexane, wherein at least one of said three $C_{10}$-$C_{18}$ hydrocarbon compounds is an aromatic compound present at greater than or equal to about 10 vol. % of the total synthetic diesel fuel composition, wherein the synthetic diesel fuel composition has a cetane number of greater than 40, a freeze point of less than or equal to about −20° C. (about −4° F.), and a density of greater than or equal to about 0.81 g/ml (about 6.8 lb/gal).

2. The synthetic diesel fuel composition of claim 1, wherein the composition comprises at least four $C_{10}$-$C_{18}$ hydrocarbon compounds selected from the group consisting of: decane, butylcyclohexane, hexylbenzene, hexylcyclohexane, octylbenzene, octylcyclohexane, decylbenzene, decylcyclohexane, dodecylbenzene, and dodecylcyclohexane.

3. The synthetic diesel fuel composition of claim 1 consisting essentially of said $C_{10}$-$C_{18}$ hydrocarbon compounds selected from the group consisting of: decane, butylcyclohexane, hexylbenzene, hexylcyclohexane, octylbenzene, octylcyclohexane, decylbenzene, decylcyclohexane, dodecylbenzene, and dodecylcyclohexane; and conventional diesel fuel additives.

4. The synthetic diesel fuel composition of claim 1, wherein the composition has a cetane number of greater than or equal to about 45.

5. The synthetic diesel fuel composition of claim 1, wherein the composition has a cetane number of less than or equal to about 51.

6. The synthetic diesel fuel composition of claim 1, wherein the density is greater than or equal to about 0.81 g/ml (about 6.8 lb/gal) to less than or equal to about 0.84 g/ml (about 7.0 lb/gal).

7. The synthetic diesel fuel composition of claim 1, wherein the freeze point temperature is about −56° C. (about −69° F.) to about −20° C. (about −4° F.).

8. The synthetic diesel fuel composition of claim 1, further comprising at least one conventional diesel fuel additive selected from the group consisting of: antioxidant packages, detergents, friction reducers, anti-wear additives and/or lubricity enhancing agents, corrosion inhibitors, cetane improvers, cold flow improvers, biocides or biostats (which destroy or inhibit the growth of fungi and bacteria), non-metallic dispersants, non-metallic detergents, corrosion and rust inhibitors, metal deactivators, defoamants, dyes, markers, antistatic additives, combustion enhancers, and combinations thereof.

9. A synthetic diesel fuel composition comprising at least three $C_{10}$-$C_{18}$ hydrocarbon compounds selected from the group consisting of decane, butylcyclohexane, hexylbenzene, hexylcyclohexane, octylbenzene, octylcyclohexane, decylbenzene, decylcyclohexane, dodecylbenzene, and dodecylcyclohexane, wherein the synthetic diesel fuel composition comprises at least one aromatic hydrocarbon compound at greater than or equal to about 10 vol. % of the total composition and the composition has a cetane number of greater than or equal to about 42 and less than or equal to about 51, a freeze point of less than or equal to about −20° C. (about −4° F.), and a density of greater than or equal to about 0.81 g/ml (about 6.8 lb/gal) and less than or equal to about 0.84 g/ml (about 7.0 lb/gal).

10. The synthetic diesel fuel composition of claim 9, wherein the composition comprises from four to ten of said $C_{10}$-$C_{18}$ hydrocarbon compounds selected from the group consisting of: decane, butylcyclohexane, hexylbenzene, hexylcyclohexane, octylbenzene, octylcyclohexane, decylbenzene, decylcyclohexane, dodecylbenzene, and dodecylcyclohexane.

11. The synthetic diesel fuel composition of claim 9, wherein said at least one aromatic hydrocarbon compound is selected from the group consisting of: hexylbenzene, octylbenzene, decylbenzene, and dodecylbenzene.

12. The synthetic diesel fuel composition of claim 9 consisting essentially of said $C_{10}$-$C_{18}$ hydrocarbon compounds selected from the group consisting of: decane, butylcyclohexane, hexylbenzene, hexylcyclohexane, octylbenzene, octylcyclohexane, decylbenzene, decylcyclohexane, dodecylbenzene, and dodecylcyclohexane; and conventional diesel fuel additives.

13. The synthetic diesel fuel composition of claim 9, wherein the freeze point temperature is about −56° C. (about −69° F.) to about −20° C. (about −4 ° F.).

14. A method for formulating a synthetic diesel fuel composition comprising:

admixing three or more $C_{10}$-$C_{18}$ hydrocarbon compounds selected from the group consisting of decane, butylcyclohexane, hexylbenzene, hexylcyclohexane, octylbenzene, octylcyclohexane, decylbenzene, decylcyclohexane, dodecylbenzene, and dodecylcyclohexane, wherein the composition comprises at least one aromatic hydrocarbon compound at greater than or equal to about 10 vol. % to form a synthetic diesel fuel mixture having a cetane number of greater than 40, a freeze point of less than or equal to about −20° C. (about −4° F.), and a density of greater than or equal to about 0.81 g/ml (about 6.8 lb/gal).

15. The method of claim 14, where said admixing further comprises adding one or more conventional diesel fuel additives selected from the group consisting of: antioxidant packages, detergents, friction reducers, anti-wear additives and/or lubricity enhancing agents, corrosion inhibitors, cetane improvers, cold flow improvers, biocides or biostats (which destroy or inhibit the growth of fungi and bacteria), non-metallic dispersants, non-metallic detergents, corrosion and rust inhibitors, metal deactivators, defoamants, dyes, markers, antistatic additives, combustion enhancers, and combinations thereof.

16. The method of claim 14, where said admixing comprises adding one or more of said $C_{10}$-$C_{18}$ hydrocarbon compounds respectively at about 1 to about 75% by volume.

17. A synthetic diesel fuel composition comprising at least three $C_{10}$-$C_{18}$ hydrocarbon compounds, wherein at least one of said three $C_{10}$-$C_{18}$ hydrocarbon compounds is an aromatic compound selected from the group consisting of: hexylbenzene, octylbenzene, decylbenzene, and dodecylbenzene and present at greater than or equal to about 10 vol. % of the total synthetic diesel fuel composition, wherein the synthetic diesel fuel composition has a cetane number of greater than 40, a freeze point of less than or equal to about −20° C. (about −4° F.), and a density of greater than or equal to about 0.81 g/ml (about 6.8 lb/gal).

* * * * *